US009657698B2

(12) United States Patent
Park et al.

(10) Patent No.: US 9,657,698 B2
(45) Date of Patent: May 23, 2017

(54) FUEL PUMP MODULE MOUNTED WITH CONTROLLER

(71) Applicant: Hyundam Industrial Co., Ltd., Asan-si, Chungcheongnam-do (KR)

(72) Inventors: Kyoung Sik Park, Asan-si (KR); Kwan Beom Oh, Seoul (KR); Won Sang Cho, Asan-si (KR); Jin Wook Chang, Asan-si (KR)

(73) Assignee: Hyundam Industrial Co., Ltd., Chungcheongnam-do (KR)

( * ) Notice: Subject to any disclaimer, the term of this patent is extended or adjusted under 35 U.S.C. 154(b) by 0 days.

(21) Appl. No.: 14/423,322

(22) PCT Filed: Oct. 21, 2014

(86) PCT No.: PCT/KR2014/009882
§ 371 (c)(1),
(2) Date: Feb. 23, 2015

(87) PCT Pub. No.: WO2015/060618
PCT Pub. Date: Apr. 30, 2015

(65) Prior Publication Data

US 2016/0252058 A1 Sep. 1, 2016

(30) Foreign Application Priority Data

Oct. 21, 2013 (KR) ..... 10-2013-0125313
Apr. 1, 2014 (KR) ..... 10-2014-0038599

(51) Int. Cl.
*F02M 37/00* (2006.01)
*F02M 37/04* (2006.01)
(Continued)

(52) U.S. Cl.
CPC ..... *F02M 37/04* (2013.01); *F02M 37/007* (2013.01); *F02M 37/106* (2013.01);
(Continued)

(58) Field of Classification Search
CPC .. F02M 37/04; F02M 37/08; F02M 2037/082; F02M 2037/085; F02M 37/103; F02M 37/106
(Continued)

(56) References Cited

U.S. PATENT DOCUMENTS 5,038,741 A * 8/1991 Tuckey ..... F02M 37/103 123/497
5,075,822 A * 12/1991 Baumler ..... H05K 7/20854 123/41.31
(Continued)

FOREIGN PATENT DOCUMENTS

JP 2006-161599 A 6/2006
JP 2008-031896 A 2/2008
(Continued)

OTHER PUBLICATIONS

International Search Report (in Korean with English translation) and Written Opinion (in Korean) for PCT/KR2014/009882, mailed Jan. 28, 2015; ISA/KR.

*Primary Examiner* — Thomas Moulis
(74) *Attorney, Agent, or Firm* — Harness, Dickey & Pierce, P.L.C.

(57) ABSTRACT

Disclosed herein is a vehicle fuel pump module. The vehicle fuel pump module is configured such that a controller is spaced apart from a plate body installed so as to be exposed out of a fuel tank by a support member and an air gap is provided between the plate body and the controller. Consequently, a gas generated from a fuel in the fuel tank is discharged to the atmosphere by an outdoor air circulating the air gap and thus it may be possible to prevent the gas from affecting electronic parts of the controller.

4 Claims, 4 Drawing Sheets

(51) Int. Cl.
*F02M 37/10* (2006.01)
*F02M 37/08* (2006.01)

(52) U.S. Cl.
CPC ..... *F02M 37/103* (2013.01); *F02M 2037/082* (2013.01); *F02M 2037/085* (2013.01)

(58) Field of Classification Search
USPC ..... 123/509, 41.61
See application file for complete search history.

(56) References Cited

U.S. PATENT DOCUMENTS 5,454,697 A * 10/1995 Nakanishi ..... F02M 37/10 123/509
6,132,184 A * 10/2000 Robertson ..... F04D 13/06 417/366
6,600,653 B2 * 7/2003 Koike ..... H05K 5/0043 123/41.31
6,745,823 B2 * 6/2004 Brost ..... F28F 3/04 123/41.31
7,314,040 B2 1/2008 Yagi et al.
7,808,784 B2 * 10/2010 Graf ..... B60K 15/03 165/104.33
8,869,775 B2 * 10/2014 Maruyama ..... F02M 37/08 123/497
9,316,170 B2 * 4/2016 Song ..... F02D 41/3082
9,470,192 B2 * 10/2016 Honda ..... F17D 1/08
2005/0100461 A1 * 5/2005 Izutani ..... B01D 35/027 417/423.8
2005/0265852 A1 * 12/2005 Nakazawa ..... B60T 8/368 417/63
2005/0281684 A1 * 12/2005 Kumagai ..... F02M 37/10 417/360
2006/0032663 A1 * 2/2006 Hosoya ..... B60K 15/03 174/151
2006/0120893 A1 6/2006 Yagi et al.
2006/0162702 A1 * 7/2006 Lahn ..... F02D 41/3082 123/497
2006/0272150 A1 * 12/2006 Eguchi ..... H05K 3/284 29/841
2007/0253845 A1 * 11/2007 Suzuki ..... F02M 31/20 417/423.8
2008/0011276 A1 * 1/2008 Satoh ..... F02M 37/106 123/509
2009/0031995 A1 * 2/2009 Tateishi ..... F02M 37/106 123/509
2009/0103268 A1 * 4/2009 Bryan ..... H05K 7/20 361/711
2009/0183715 A1 * 7/2009 Yamamoto ..... F02M 37/0082 123/497
2009/0193873 A1 * 8/2009 Nakamura ..... F02D 33/003 73/31.05
2009/0293966 A1 * 12/2009 Murakoshi ..... F02M 37/103 137/565.01
2012/0222655 A1 * 9/2012 Powell ..... F02M 37/103 123/509

FOREIGN PATENT DOCUMENTS

JP 2010-196529 A 9/2010
JP 2010-285929 A 12/2010
KR 20-0160774 Y1 12/1999
KR 10-2012-0136942 A 12/2012
KR 10-2013-0042948 A 4/2013

* cited by examiner

FUEL PUMP MODULE MOUNTED WITH CONTROLLER

CROSS-REFERENCE TO RELATED APPLICATIONS

This application is a 371 U.S. National Stage of International Application No. PCT/KR2014/009882, filed on Oct. 21, 2014, which claims the priority to Korean Application Nos. 10-2013-0125313, filed on Oct. 21, 2013, and 10-2014-0038599, filed on Apr. 1, 2014. The entire disclosures of the above applications are herein incorporated by reference.

TECHNICAL FIELD

The present invention relates to a fuel pump module, and more particularly, to a vehicle fuel pump module mounted with a controller, which is configured such that a controller is spaced apart from a fuel tank so as to enable a gas generated from fuel to be prevented from entering the controller.

BACKGROUND ART

In general, a vehicle fuel device allows a mixed gas required for an engine to be supplied in a state of being very easily combusted under all driving conditions. This significantly affects performance of the engine, namely, power or economics of the engine.

The fuel device includes a fuel supply device, which suitably mixes fuel with air and supplies the mixed gas to the engine, as a main component. The fuel supply device includes a fuel tank which stores fuel, and a fuel pump module which forcibly supplies the fuel stored in the fuel tank to the engine.

The fuel pump module is a device which pumps the fuel out of the fuel tank and feeds the fuel into the engine. Fuel pump modules are classified into a mechanical fuel pump module using rotational force of an engine cam shaft and an electric fuel pump module using a direct current motor or a piston (plunger). In general, the electric fuel pump module is widely used. Since the electric fuel pump module is submerged in the fuel within the fuel tank, the electric fuel pump module has an excellent function of suppressing pump operation noise and vapor lock.

Such a fuel pump module is disclosed in Korean Utility Model Publication No. 20-0160774 (Aug. 19, 1999) (Patent Document 1), Korean Patent Laid-Open Publication No. 10-2013-0042948 (Apr. 29, 2013) (Patent Document 2), and Korean Patent Laid-Open Publication No. 10-2012-0136942 (Dec. 20, 2012) (Patent Document 3).

A conventional fuel pump module is largely configured of a plate assembly fixed to a fuel tank, and a reservoir body assembly connected to a lower side of the plate assembly by a guide rod.

The reservoir body assembly includes a reservoir body, a fuel pump provided in the reservoir body to suck fuel into the reservoir body, and an in-tank filter provided in the reservoir body to filter the sucked fuel.

The plate assembly includes a supply port which connects a connection hose to a plate body for feeding the fuel to the engine, a plate having a valve seating portion, a roll-over valve, and a fuel limit vent valve.

The plate assembly includes a controller which receives signals from an ECU (Electronic Control Unit) and controls driving of the fuel pump based on signals output by determining an amount of fuel injection and a driving speed of the fuel pump according to pressure and temperature in a fuel line and driving conditions.

The controller has a PCB substrate which is fixedly installed on an upper surface of the plate body, and a plurality of electric parts such as a condenser and a terminal are installed on the PCB substrate.

Since the controller is installed on the upper surface of the plate body provided to be exposed to the outside of the fuel tank, gases generated from the fuel in the fuel tank may penetrate the plate body and enter the controller. For this reason, the conventional fuel pump module has a possibility of failure of electronic parts being caused or impact energy generated by explosion of inner parts such as a condenser being transferred to the plate of the fuel pump module.

DISCLOSURE

Technical Problem

Accordingly, the present invention has been made in view of the above-mentioned problem, and an object thereof is to provide a vehicle fuel pump module mounted with a controller, capable of preventing a gas generated from fuel in a fuel tank from affecting electronic parts due to entering a controller.

Technical Solution

In accordance with an aspect of the present invention, a vehicle fuel pump module mounted with a controller includes a plate assembly installed so as to be exposed out of a fuel tank, and a reservoir assembly installed in the fuel tank and connected to the plate assembly, wherein the plate assembly includes a plate body coupled to the fuel tank, a controller spaced apart from the plate body, and including a frame member having an inner space and an opened upper portion, a PCB substrate coupled to the inner space of the frame member, and electronic parts installed on the PCB substrate, a plurality of support members allowing the frame member to be spaced apart from the plate body, and an air gap formed between the plate body and the controller, and allowing an outdoor air to be circulated for discharging a gas generated from a fuel in the fuel tank to the atmosphere without absorption/infiltration of the gas to the controller.

The frame member of the controller may be formed of one piece by injection molding such that the gas is not infiltrated throughout a surface facing the fuel tank.

The controller may be configured such that the frame member is filled with a molding member for enclosing the electronic parts so as not to affect the electronic parts even though the gas penetrates the frame member and minutely enters the frame member.

A condenser of the electronic parts may be provided above the air gap and an impact generated during explosion of the condenser may be reduced by the air gap, so that the air gap prevents damage of the frame member and has a damage prevention function such that the fuel in the fuel tank is leaked.

Additional advantages, objects, and features of the invention will be set forth in part in the description which follows and in part will become apparent to those having ordinary skill in the art upon examination of the following or may be learned from practice of the invention.

BRIEF DESCRIPTION OF DRAWINGS

The above and other objects, features and other advantages of the present invention will be more clearly understood from the following detailed description taken in conjunction with the accompanying drawings, in which.

BEST MODE FOR INVENTION

Reference will now be made in detail to embodiments of the present invention, examples of which are illustrated in the accompanying drawings. The drawings are not necessarily to scale and in some instances, proportions may have been exaggerated in order to clearly illustrate features of the embodiments.

Figure 1:
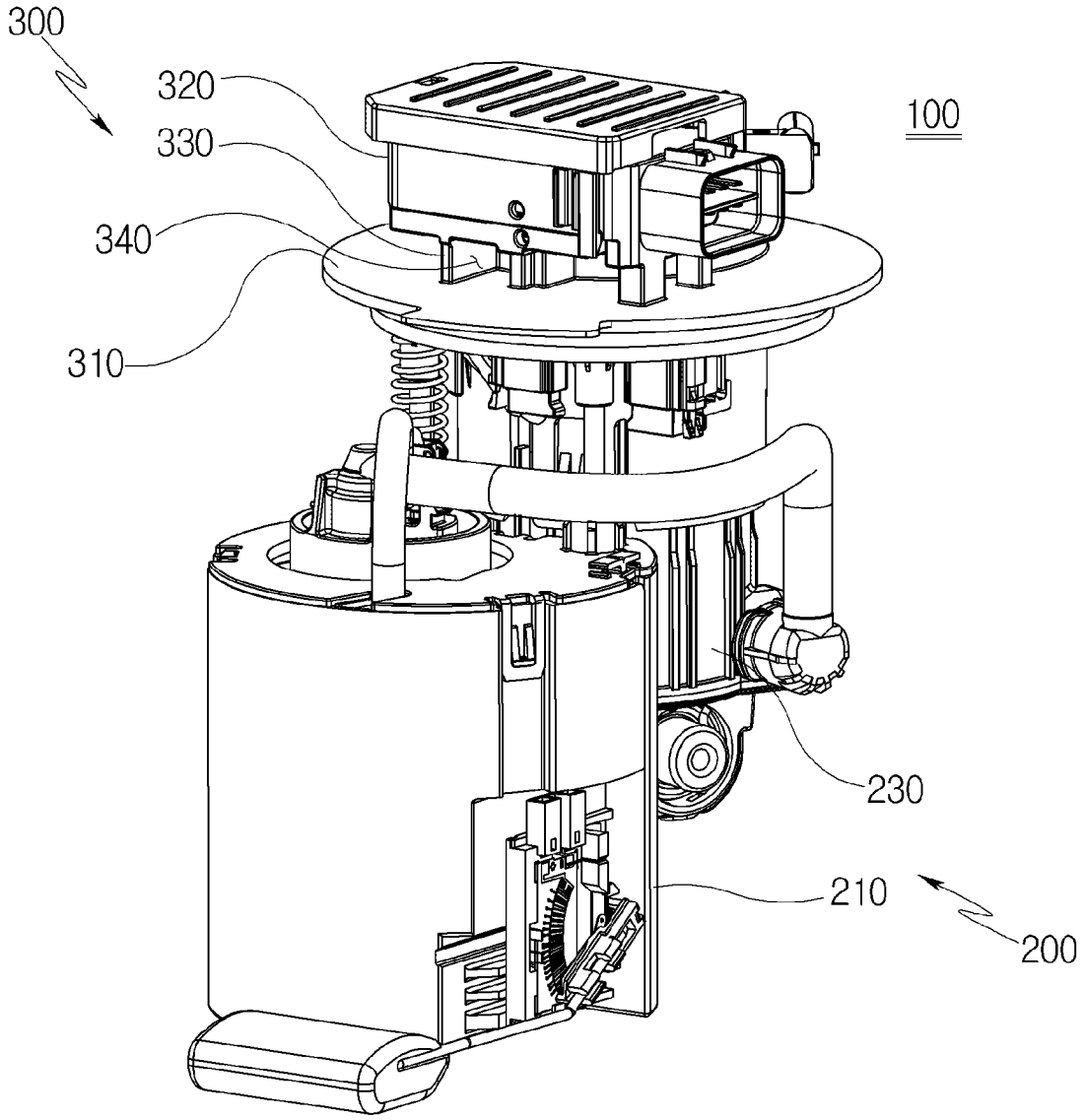
FIG. 1 is a perspective view illustrating a vehicle fuel pump module according to a first embodiment of the present invention.
Figure 2:
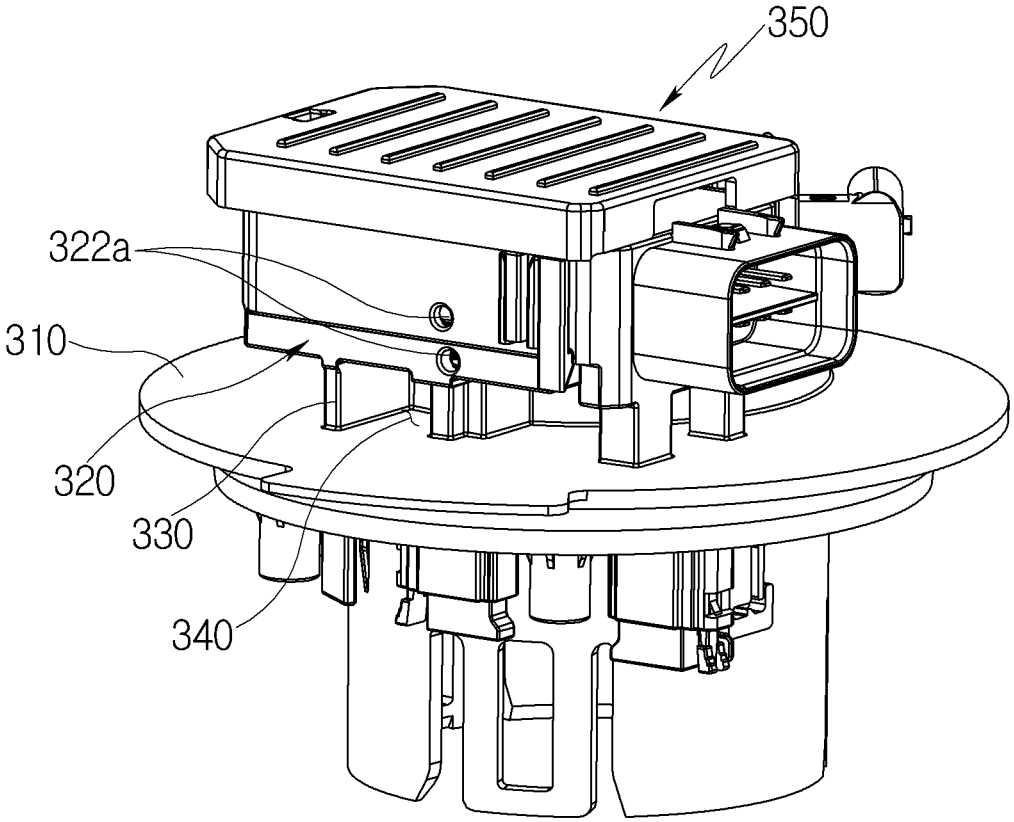
FIG. 2 is a perspective view illustrating a plate assembly of the vehicle fuel pump module in FIG. 1.
Figure 3:
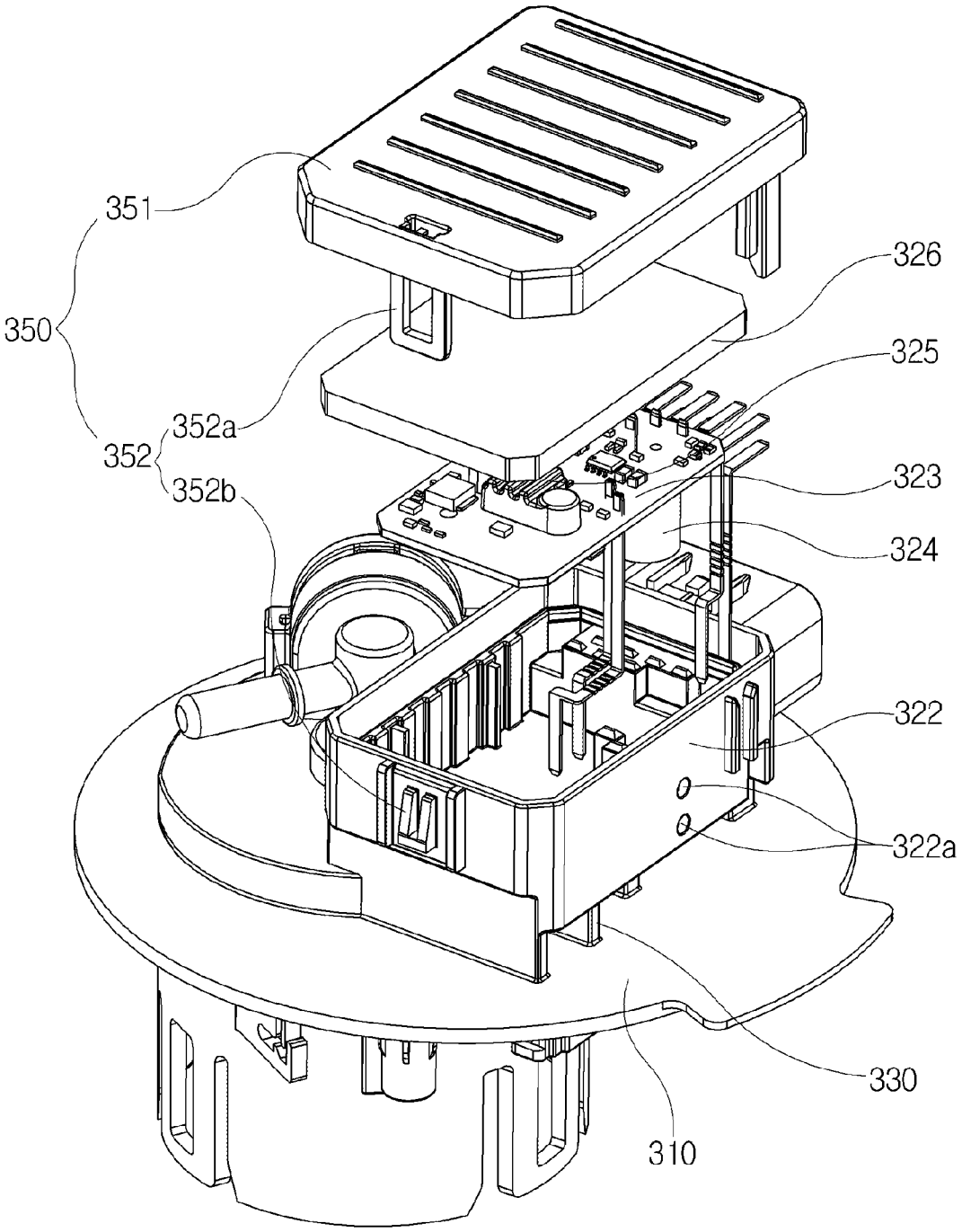
FIG. 3 is an exploded perspective view illustrating a state in which a cover member is separated from the plate assembly of the vehicle fuel pump module in FIG. 1.
Figure 4:
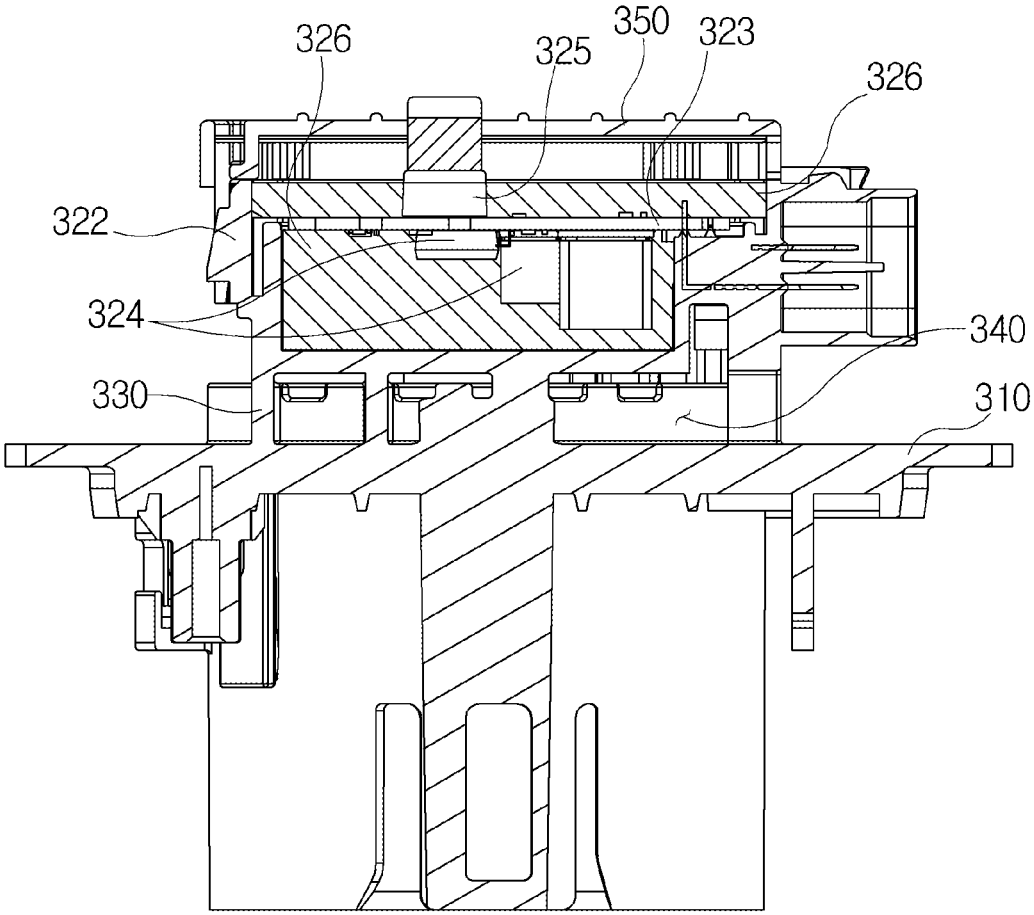
FIG. 4 is a cross-sectional view illustrating the plate assembly of the vehicle fuel pump module in FIG. 2.

FIG. 1 is a perspective view illustrating a vehicle fuel pump module according to a first embodiment of the present invention. FIG. 2 is a perspective view illustrating a plate assembly of the vehicle fuel pump module in FIG. 1. FIG. 3 is an exploded perspective view illustrating a state in which a cover member is separated from the plate assembly of the vehicle fuel pump module in FIG. 1. FIG. 4 is a cross-sectional view illustrating the plate assembly of the vehicle fuel pump module in FIG. 2.

As shown in the drawings, a vehicle fuel pump module 100 according to an embodiment of the present invention includes a reservoir assembly 200 installed on a bottom in a fuel tank and a plate assembly 300 installed so as to be exposed to the outside from an upper side of the fuel tank.

The reservoir assembly 200 includes a reservoir cup 210 installed on the bottom in the fuel tank, a fuel pump installed to the reservoir cup 210 to pump fuel in the fuel tank, and a fuel filter 230 for filtering foreign substances of the fuel or the like when the fuel in the fuel tank is supplied to an engine.

The reservoir cup 210 has a cup shape an upper portion of which is opened and has an inner space. A plurality of parts are installed in the inner space. The reservoir cup is installed on the bottom in the fuel tank. A pressure regulation portion capable of uniformly maintaining a fuel pressure is installed to a lower side of the inner space of the reservoir cup 210.

The fuel pump is installed in the inner space of the reservoir cup 210 to pump the fuel in the fuel tank. The fuel pump serves to suck the fuel when electricity is supplied thereto and then discharge the fuel to a feed pipe.

The fuel filter 230 filters foreign substances contained in the fuel when the fuel in the fuel tank is supplied to the engine, and is installed in the inner space of the reservoir cup 210.

The feed pipe for guiding the fuel pumped by the fuel pump to the outside of the fuel tank is connected to an upper portion of the fuel pump or fuel filter 230. An end portion of the feed pipe is fixed to the plate assembly 300 coupled to the fuel tank.

In the fuel pump module according to the first embodiment of the present invention, the plate assembly 300 has a structure in which a controller 320 provided to control the fuel pump is spaced apart from the fuel tank so as to prevent a gas (oil mist) generated from the fuel in the fuel tank from entering electronic parts 324 of the controller 320. The plate assembly 300 includes a plate body 310, a controller 320, a support member 330, and an air gap 340.

The plate body 310 is fitted into a through-hole formed on the fuel tank and is seated around the through-hole so as to be coupled to the fuel tank. An upper surface of the plate body 310 is exposed to the outside of the fuel tank.

The controller 320 controls an amount of fuel injection and a driving speed of the fuel pump according to pressure and temperature in a fuel line and driving conditions. The controller 320 is provided above the plate body 310 so as to be spaced apart from the plate body 310.

The controller 320 is spaced apart from the plate body 310. The controller 320 includes a frame member 322 having an inner space and an opened upper portion, a PCB substrate 323 coupled into the inner space of the frame member 322, electronic parts 324 installed on the PCB substrate 323, and a cover 350 for covering the opened upper portion of the frame member 322.

The frame member 322 has a box shape an upper portion of which is opened. The frame member 322 is formed of one piece by injection molding. The PCB substrate 323 on which the electronic par 324 is installed is provided in the inner space of the frame member 322.

Since the frame member 322 is formed of one piece, no clearance is formed around a back surface of the frame member 322 facing the upper surface of the fuel tank. Consequently, an evaporation gas generated from the fuel is prevented from entering the frame member 322.

The PCB substrate 323 is provided with a connection terminal connected to a connector for connection with an external power source. The connection terminal is provided in a connection portion which protrudes outward of the frame member 322 and has a groove shape. That is, the connection terminal is exposed to the connection portion so as to be connected to the connector for connection with the external power source.

The electronic parts 324 are installed on a back surface of the PCB substrate 323. The electronic parts 324 are configured such that a separate heat radiation plate 325 is installed on an upper surface of the PCB substrate 323 above the electronic parts 324 and then heat generated by the electronic parts 324 is radiated to the atmosphere through the heat radiation plate 325. The electronic parts 324 are configured of a FET element, a condenser, a resistance, a terminal, etc.

The support member 330 connects the frame member 322 to the plate body 310 to space the frame member 322 apart from the upper surface of the plate body 310.

The support member 330 is configured of at least one support member. As shown in the drawings, a plurality of support members 330 are formed at edges between the plate body 310 and the frame member 322 and/or at a center portion therebetween in the embodiment of the present invention.

The air gap 340 is a space defined by the support members 330 which connect the frame member 322 to the plate body 310. The air gap 340 serves to discharge a gas, which generates from the fuel in the fuel tank and penetrates the plate body 310 to be raised to the space, to the atmosphere while outdoor air passes through the space via a gap between the support members 330.

That is, since the air gap 340 serves to discharge the gas to the atmosphere, the gas is prevented from affecting the electronic parts 324 installed on the PCB substrate 323 due to entering the frame member 322.

The fuel pump module according to the first embodiment of the present invention further includes a molding member 326 which fully encloses the electronic parts 324 so as not to affect the electronic parts 324 even though the gas partially enters the frame member 322.

The molding member 326 is provided to fully enclose the electronic parts 324 installed on the PCB substrate 323 in such a manner that a liquid phase material is cooled and hardened. That is, the molding member 326 is filled in spaces above and beneath the PCB substrate 323 within the frame member 322.

The molding member 326 and the PCB substrate 323 have at least one through-hole which is formed around them to be vertically penetrated. The through-hole is connected to a drainage hole 322*a* formed on a side surface of the frame member 322 so as to communicate with the drainage hole 322*a*. Thereby, even though rainwater is introduced between the frame member 322 and a cover member 351 to be described later, the rainwater flows along an upper surface of the molding member 326 and is discharged to the outside through the through-hole and the drainage hole 322*a*.

The molding member 326 also serves to grip the electronic parts 324 in order to prevent the electronic parts 324 from colliding with each other by vibration generated when the vehicle travels and from being decoupled/damaged by the vibration.

The condenser, which is a part having an explosion possibility among the electronic parts 324, is installed above the air gap 340. That is, the condenser is installed in the frame member 322 so as to be located at a position away from the support member 330 connecting the frame member 322 to the plate body 310. Consequently, an impact generated by explosion is not transferred to the plate body 310 through the support member 330 even though the condenser is exploded, and the impact is reduced by the air gap 340 and is prevented from being transferred to the fuel tank.

The cover 350 covers the opened upper portion of the frame member 322 so as to prevent foreign substances such as rainwater, contaminants, and dust from entering the controller 320.

The cover 350 is detachably coupled to the upper portion of the frame member 322 by a coupling hole formed on a coupling rib 351 protruding from a lower portion of the cover 350 and a protrusion 352 formed on an outer surface of the frame member 322.

After a protrusion is formed on a back edge surface of the cover 350 and a groove portion is formed on an upper edge end of the frame member 322, a sealing member is interposed between the protrusion and the groove portion or a sealant is applied therebetween, thereby preventing water or foreign substances from entering between the cover 350 and the frame member 322.

In the plate assembly 300, the plate body 310, the frame member 320, and the support member 330 are integrally formed by injection molding and thus the number of parts and assembly processes are reduced. Therefore, costs of products may also be reduced.

An effect of the fuel pump module according to the first embodiment of the present invention having such a configuration will be described.

In the fuel pump module 100 according to the first embodiment of the present invention, the fuel sucked by the fuel pump 220 moves inward of the fuel filter 230 connected to the fuel pump 220 and is filtered while moving to the inside of a filter paper from the outside thereof. In addition, a portion of the fuel is supplied to the engine through a connection hose, a supply port, and a fuel supply line, and the remainder is discharged out of the fuel filter along a fuel return portion.

Accordingly, the above fuel pump module according to the embodiment of the present invention has the following structures in order to prevent the gas (oil mist) generated from the fuel in the fuel tank from entering the controller 320 so as not to affect the electronic parts 324.

First, the fuel pump module has a structure in which the frame member 322 of the controller 320 is spaced apart from the plate body 310 installed to the fuel tank by the support member 330 and the air gap 340 is configured between the plate body 310 and the controller 320, thereby allowing the gas generated from the fuel tank to be discharged to the atmosphere by outdoor air passing through the air gap 340.

Second, the fuel pump module has a structure in which the frame member 322 mounted with the electronic parts 324 is formed of a box-shaped member having the opened upper portion and is formed of one piece by injection molding, thereby fundamentally preventing generation of a clearance through which the gas generated from the fuel is infiltrated.

Third, the fuel pump module has a structure in which the spaces above and beneath the PCB substrate 323 within the frame member 322 mounted with the electronic parts 324 are filled with the liquid phase molding member 326 and thus the electronic parts 324 are fully enclosed, thereby preventing a small amount of gas from affecting the electronic parts even though the small amount of gas enters the frame member 322.

Various embodiments have been described in the best mode for carrying out the invention. Although the present invention has been described with respect to the illustrative embodiments, it will be apparent to those skilled in the art that various variations and modifications may be made without departing from the spirit and scope of the invention as defined in the following claims.

INDUSTRIAL APPLICABILITY

In accordance with the present invention, since a controller is spaced apart from a plate body installed to a fuel tank by a support member and an air gap is provided between the plate body and the controller, a gas generated from fuel may be discharged to the atmosphere by the air gap so as to prevent the gas from affecting electronic parts due to entering the frame member.

In addition, since the frame member mounted with the electronic parts is formed of one piece by injection molding, the present invention may prevent formation of a clearance through which the gas is infiltrated throughout the frame member facing the fuel tank.

In addition, since the inside of the frame member mounted with the electronic parts is filled with a liquid phase molding member and then the molding member fully encloses the electronic part by solidification, the present invention may prevent the gas from affecting the electronic parts even though the gas is minutely infiltrated into the frame member.

The invention claimed is:

1. A vehicle fuel pump module mounted with a controller, comprising:

a plate assembly installed so as to be exposed out of a fuel tank; and a reservoir assembly installed in the fuel tank and connected to the plate assembly, wherein the plate assembly comprises:

a plate body coupled to the fuel tank;

a controller spaced apart from the plate body, and comprising a frame member having an inner space and an opened upper portion, a PCB substrate coupled to the inner space of the frame member, and electronic parts installed on the PCB substrate;

a plurality of support members allowing the frame member to be spaced apart from the plate body; and an air gap formed between the plate body and the controller, and allowing an outdoor air to be circulated for discharging a gas generated from a fuel in the fuel tank to an atmosphere.

2. The vehicle fuel pump module according to claim 1, wherein the frame member of the controller is formed of one piece by injection molding such that the gas is not infiltrated throughout a surface facing the fuel tank.

3. The vehicle fuel pump module according to claim 1, wherein the controller is configured such that the frame member is filled with a molding member for enclosing the electronic parts so as not to affect the electronic parts even though the gas penetrates the frame member and minutely enters the frame member.

4. The vehicle fuel pump module according to claim 1, wherein a condenser of the electronic parts is provided above the air gap and an impact generated during explosion of the condenser is reduced by the air gap.

* * * * *